US008395554B2

(12) United States Patent
Seo et al.

(10) Patent No.: US 8,395,554 B2
(45) Date of Patent: Mar. 12, 2013

(54) ANTENNA APPARATUS AND MOBILE TERMINAL HAVING THE SAME

(75) Inventors: Jae Min Seo, Gyeonggi-do (KR); Hyun Soo Kim, Seoul (KR); Jae Sun Park, Gyeonggi-do (KR)

(73) Assignee: Samsung Electronics Co., Ltd., Samsong-ro, Yeongtong-gu, Suwon-si, Gyeonggi-do (KR)

( * ) Notice: Subject to any disclaimer, the term of this patent is extended or adjusted under 35 U.S.C. 154(b) by 344 days.

(21) Appl. No.: 12/796,923

(22) Filed: Jun. 9, 2010

(65) Prior Publication Data

US 2011/0006954 A1 Jan. 13, 2011

(30) Foreign Application Priority Data

Jul. 13, 2009 (KR) ..... 10-2009-0063369

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/702, 343/700 MS
See application file for complete search history.

(56) References Cited

U.S. PATENT DOCUMENTS 6,874,222 B2 * 4/2005 Lebaric et al. ..... 29/600
8,081,122 B2 * 12/2011 Kearney et al. ..... 343/700 MS

* cited by examiner

*Primary Examiner* — Hoang V Nguyen
(74) *Attorney, Agent, or Firm* — Cha & Reiter, LLC

(57) ABSTRACT

An antenna apparatus and a mobile terminal having the same are disclosed. The antenna apparatus includes: a first antenna portion patterned at one surface of the electronic circuit board; and a can type second antenna portion electrically connected to one end of the first antenna portion and separated from the one surface of the electronic circuit board, wherein one end of the second antenna portion is connected to the one end of the first antenna portion using a SMD method and the other end of the second antenna portion is connected to the one surface of the electronic circuit board using a SMD method through a floating pad formed in the one surface of the electronic circuit board.

13 Claims, 7 Drawing Sheets

| FREQUENCY(MHZ) | EFFICIENCY(%) | ANTENNA GAIN (dBi) |
|---|---|---|
| 824 | 24 | -6.23 |
| 837 | 30 | -5.29 |
| 849 | 32 | -4.98 |
| 869 | 32 | -4.99 |
| 881 | 22 | -6.59 |
| 894 | 17 | -7.75 |
| Avg. | 26 | -5.97 |

| FREQUENCY(MHZ) | EFFICIENCY(%) | ANTENNA GAIN (dBi) |
|---|---|---|
| 824 | 37 | -6.23 |
| 837 | 45 | -5.29 |
| 849 | 46 | -4.98 |
| 869 | 41 | -4.99 |
| 881 | 30 | -5.29 |
| 894 | 27 | -5.75 |
| Avg. | 38 | -4.19 |

FIG. 7

| FREQUENCY(MHZ) | EFFICIENCY(%) | ANTENNA GAIN (dBI) |
|---|---|---|
| 824 | 48 | -3.15 |
| 837 | 58 | -2.35 |
| 849 | 65 | -1.84 |
| 869 | 69 | -1.64 |
| 881 | 54 | -2.65 |
| 894 | 47 | -3.31 |
| Avg. | 57 | -2.49 |

ANTENNA APPARATUS AND MOBILE TERMINAL HAVING THE SAME

CLAIM OF PRIORITY

This application claims, pursuant to 35 USC 119, priority to, and the benefit of the earlier filing date of, that patent application filed in the Korean Patent Office, on Jul. 13, 2009, entitled "Antenna Apparatus And Mobile Terminal Having The Same" and afforded serial number 10-2009-0063369, the contents of which are incorporated by reference herein.

BACKGROUND OF THE INVENTION

1. Field of the Invention

The present invention relates to a mobile terminal, and more particularly, to an antenna apparatus and a mobile terminal having the same.

2. Description of the Related Art

In general, a mobile terminal is an electronic device that can enable a user to perform a plurality of functions, such as wireless communication, network connection, and digital broadcasting reception, regardless of time and location. Mobile terminals have been further been developed to perform functions such as Internet connection and digital broadcasting reception as well as a communication function. Furthermore, functions for document writing and game playing have been added to the mobile terminal.

According to current trends in mobile terminal technology mobile terminals have continued to decrease in size while adding more functions and capabilities. To support decrease in terminal size, antenna apparatus for transmitting and receiving a wireless signal have also continued the trend of decrease size. Such antenna provides wideband, and multiplex band coverage while being internal to the mobile terminal. The internal antenna is classified into a planar inverted F antenna (PIFA), small loop antenna, chip antenna, and/or surface mounted device (SMD) antenna.

Due to restriction in internal space of the mobile terminal, such an internal antenna apparatus is installed adjacent to other accessories. However, because such accessories include a metal portion, such as a metal wire therein, radiation performance of the antenna is not appropriately exhibited because of the adjacent metal portion. Particularly, in an internal antenna apparatus of a relatively cheap mobile terminal, a carrier is removed and a pattern is formed on a circuit board, and in this case, an antenna apparatus of a pattern form should be separated from a key input unit of a dome key form. To avoid the interference from the metal portions, the antenna apparatus is separated from accessories. However, this separation causes the size of the mobile terminal to increase.

Therefore, an antenna apparatus that can improve radiation performance of the antenna while decreasing a size of the mobile terminal is needed.

SUMMARY OF THE INVENTION

The present invention provides an antenna apparatus and a mobile terminal having the same that can improve radiation performance of the antenna while decreasing a size of the mobile terminal.

In accordance with an aspect of the present invention, an antenna apparatus installed on an electronic circuit board mounted within a main body of a mobile terminal, the antenna apparatus for transmitting and receiving a wireless signal, the apparatus comprising: a first antenna portion patterned on one surface of the electronic circuit board; and a can type second antenna portion electrically connected to one end of the first antenna portion and separated from the one surface of the electronic circuit board, wherein the one end of the second antenna portion is connected to the one end of the first antenna portion using a SMD method and the other end of the second antenna portion is connected to the one surface of the electronic circuit board using a SMD method through a floating pad formed in the one surface of the electronic circuit board, and a coupling hole for inserting the other end of the second antenna portion formed in the one surface of the electronic circuit board in order to fix and support the second antenna.

In accordance with another aspect of the present invention, a mobile terminal includes: a main body having an electronic circuit board therein; and an antenna apparatus, electrically connected to the electronic circuit board, for transmitting and receiving a wireless signal, the antenna apparatus includes: a first antenna portion patterned on one surface of the electronic circuit board; and a can type second antenna portion electrically connected to one end of the first antenna portion and separated from the one surface of the electronic circuit board, wherein one end of the second antenna portion is connected to the one end of the first antenna portion using a SMD method and the other end of the second antenna portion is connected to the one surface of the electronic circuit board using a SMD method through a floating pad formed in the one surface of the electronic circuit board, and a coupling hole for inserting the other end of the second antenna portion formed in the one surface of the electronic circuit board in order to fix and support the second antenna portion.

In another aspect of the invention, an antenna apparatus comprising: a first portion patterned on a first surface of a printed circuit board; and a second portion separate from and extending parallel to the first portion, wherein a first end of the first portion and a first end of the second portion are electrically connected by a connection extending perpendicular from the printed circuit board and second end of the second portion is connected to a pad on the printed circuit board.

In another aspect of the invention, an antenna apparatus comprising: a first portion patterned on a first surface of a printed circuit board; and a second portion separate from and extending parallel to the first portion, wherein a first end of the first portion and a first end of the second portion are electrically connected by a connection extending perpendicular from the printed circuit board and second end of the second portion is connected to a pad on the printed circuit board.

BRIEF DESCRIPTION OF THE DRAWINGS

The above features and advantages of the present invention will be more apparent from the following detailed description in conjunction with the accompanying drawings, in which:

FIG. 7 is a table illustrating the result of radiation efficiency measured using an antenna apparatus of a mobile terminal according to an exemplary embodiment of the present invention.

DETAILED DESCRIPTION OF THE INVENTION

Figure 1:
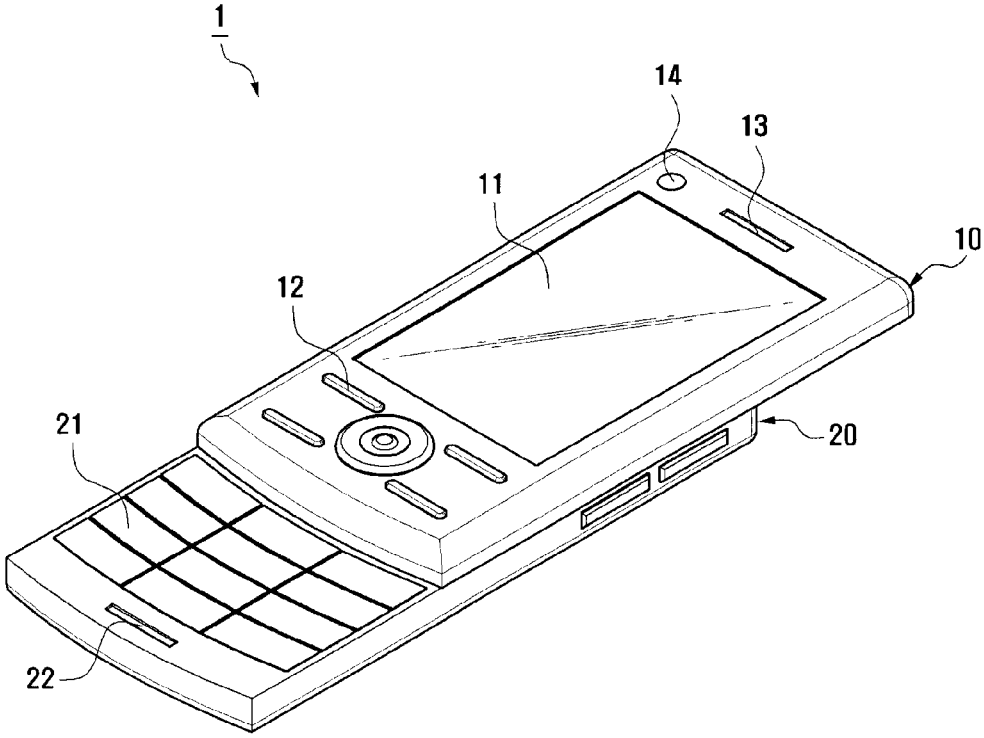
FIG. 1 (PRIOR ART)
FIG. 1 is a perspective view illustrating a mobile terminal according to an exemplary embodiment of the present invention.

Hereinafter, exemplary embodiments of the present invention are described in detail with reference to the accompanying drawings. The same reference numbers are used throughout the drawings to refer to the same or like parts. The views in the drawings are schematic views only, and are not intended to be to scale or correctly proportioned. For the purposes of clarity and simplicity, detailed descriptions of well-known functions and structures incorporated herein may be omitted to avoid obscuring the subject matter of the present invention.

While the present invention may be embodied in many different forms, specific embodiments of the present invention are shown in drawings and are described herein in detail, with the understanding that the present disclosure is to be considered as an exemplification of the principles of the invention and is not intended to limit the invention to the specific embodiments illustrated.

In the following description, for convenience of description, a mobile terminal according to the present invention is a mobile communication terminal such as a mobile phone, however the present invention is not limited thereto and may be an information and communication device or a multimedia device such as a mobile communication terminal, mobile phone, personal digital assistant (PDA), smart phone, International Mobile Telecommunication 2000 (IMT-2000) terminal, code division multiple access (CDMA) terminal, wideband code division multiple access (WCDMA) terminal, Global System for Mobile Communication (GSM) terminal, general packet radio service (GPRS) terminal, enhanced data GSM environment (EDGE) terminal, universal mobile telecommunication service (UMTS) terminal, digital broadcasting terminal, and applications thereof.

Figure 2:
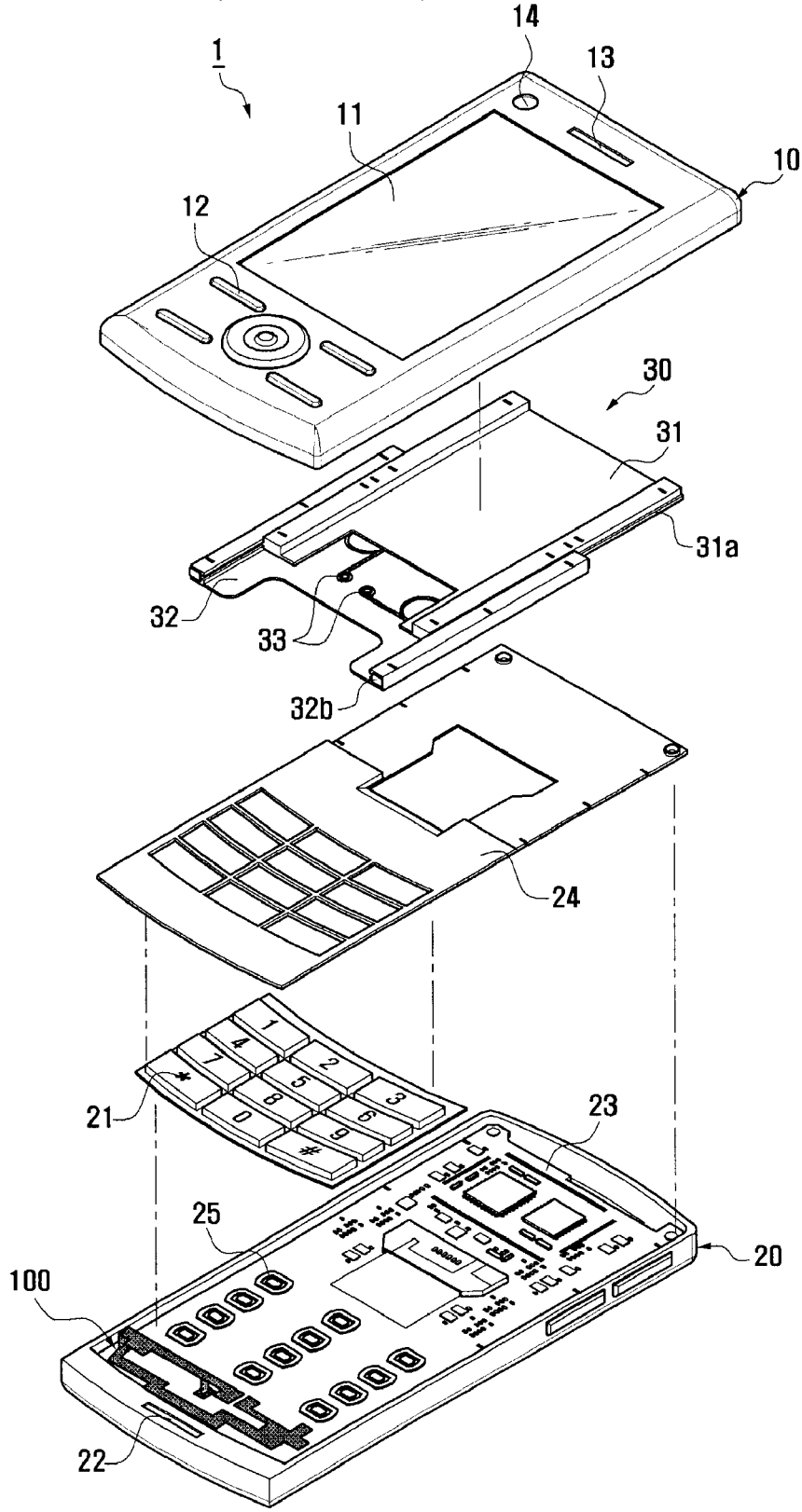
FIG. 2 (PRIOR ART)
FIG. 2 is an exploded perspective view illustrating a structure of the mobile terminal of FIG. 1.

FIG. 1 is a perspective view illustrating a mobile terminal according to an exemplary embodiment of the present invention, and FIG. 2 is an exploded perspective view illustrating a structure of the mobile terminal of FIG. 1.

Referring to FIG. 1, a general slide type mobile terminal 1 has an upper case 10 including a display unit 11 and a lower case 20 including a key input unit 21 at a front surface thereof. The upper case 10 vertically moves by a sliding movement on the lower case 20.

The display unit 11 performs a function of a user interface for outputting a desired screen to a user or receiving an instruction from a user. As the display unit 11, a liquid crystal display (LCD) and an organic light emitting diode (OLED) can be used. The display unit 11 may have a function of a touch screen in order to receive an instruction from a user, as needed.

The key input unit 21 for receiving a manipulation instruction from the user is formed in an upper surface of the lower case 20, and when the upper case 10 is separated from the lower case 20 by a sliding movement, the upper case 10 is exposed to the outside. The key input unit 21 can be formed in a dome key form including a plurality of key buttons.

Refrying to FIG. 2, the key input unit 21 includes a keypad having a plurality of key buttons formed with character/numeral keys, a power source key, a communication key, and a navigation key, and a dome sheet (not shown) having a plurality of dome switches. The keypad is coupled to a lower surface of a front cover 24 for covering an upper surface of the lower case 20. A plurality of electrode patterns 25 disposed at positions corresponding to the plurality of key buttons and the plurality of dome switches, respectively, are formed at an upper surface of an electronic circuit board 23. The plurality of electrode patterns 25 can be formed with a plurality of contact points made of a metal material, and a plurality of contact points each are not electrically connected in an initial state. Thus, when a key button is pressed, a dome switch is deformed so as to be electrically connected to a corresponding contact point. Although described later, the antenna apparatus 100 is separated by a predetermined distance from the plurality of electrode pattern 25.

FIG. 1 illustrates an example in which the key input unit 21 for receiving a manipulation instruction from a user is formed in a lower end portion of the upper case 10, i.e. in a lower end portion of the display unit 11, but an entire upper surface of the upper case 10 may be formed as the display unit 11. The key input unit 21 can be formed in a lower end portion or a side surface of the upper case 10, and when the upper case 10 and the lower case 20 are coupled, in order to receive the input from a user, the key input unit 21 is formed with minimum function keys such as a power source key for turning on/off a power source of the mobile terminal 1, communication key for performing communication with another party, and navigation key for selecting menus displayed on the display unit 11.

As shown in FIG. 1, the mobile terminal 1 may have an earpiece 13 provided in an upper end portion of the upper case 10 to output a sound signal and a mouthpiece 22 provided in a lower end portion of the lower case 20 to input a sound signal. The user can hear a sound signal received from another party using the earpiece 13 and transmit a sound signal to another party using the mouthpiece 22. Further, the mobile terminal 1 may have a camera unit 14 for photographing a front subject or for performing audiovisual communication in an upper end portion of the upper case 10.

A sliding hinge 30 (FIG. 2) for guiding the upper case 10 to perform a sliding movement on the lower case 20 is provided between the upper case 10 and the lower case 20. As shown in FIG. 2, the sliding hinge 30 includes a first sliding member 31 connected to a lower surface of the upper case 10, second sliding member 32 connected to an upper surface of the lower case 20, and hinge portion 33 installed between the first sliding member 31 and the second sliding member 32. In order to guide a sliding movement of the upper case 10, a protrusion 31*a* formed in a moving direction of the upper case 10 is provided at both side surfaces of the first sliding member 31, and a groove 32*b* formed to insert the protrusion 31*a* of the first sliding member 31 is provided at both side surfaces of the second sliding member 32. The hinge portion 33 is formed with an elastic member, such as a compression spring, for providing an elastic force so that the upper case 10 automatically or semi-automatically performs a sliding movement according to a position thereof. A structure of the sliding hinge 30 shown in FIG. 2 is an example, and a structure of the sliding hinge 30 is not limited thereto and can be changed.

As shown in FIG. 2, the antenna apparatus 100, which performs the function of transmitting and receiving a wireless signal, is electrically connected to the electronic circuit board 23. Due to restriction in internal space of the mobile terminal 1, the antenna apparatus 100 is mounted within a lower end portion of the lower case 20. FIG. 2 illustrates an example in which the antenna apparatus 100 is installed at an upper surface of the electronic circuit board 23, however, it would be recognized by those skilled in the art, that the antenna apparatus 100 may be installed at a lower surface of the electronic circuit board 23, without altering the principles of the invention. The structure of the antenna apparatus 100 is described later in detail with reference to FIGS. 3 and 4.

As shown in FIG. 2, the electronic circuit board 23 is mounted within the lower case 20, and various function modules, such as the display unit 11, key input unit 21, earpiece 13, mouthpiece 22, and camera unit 14, constituting the mobile terminal 1 are electrically connected to the electronic circuit board 23. Signals received from the electronic circuit board 23 provide control to the different function modules. The electronic circuit board 23 has an approximately thin plate shape and includes various electronic components and wires for connecting them at an upper surface or a lower surface. The electronic components are various kinds of elements such as a modem chip. Preferably, the electronic circuit board 23 is a printed circuit board (PCB). When the mobile terminal 1 is used, noise may occur in various electronic components mounted in the electronic circuit board 23 and in order to shield against such noise, a noise shield unit (not shown), such as a shield can, may be installed on an upper surface of the electronic circuit board 23. Further, various function modules such as the display unit 11 and the camera unit 14 receive an electrical signal from the electronic circuit board 23 for their control. Thus, in order to transmit and receive various electrical signals by connecting the electronic circuit board 23 and function modules, a flexible printed circuit board (FPCB) (not shown) in which a micro circuit is printed on a thin plate film of a flexible plastic material can be used.

FIG. 1 illustrates a slide type mobile terminal 1, however a form of the mobile terminal is not limited thereto and the present invention can be applied to a mobile terminal 1 of various forms, such as a bar type, a flip type, a folder type, a rotating type, and combination type thereof.

Figure 3:
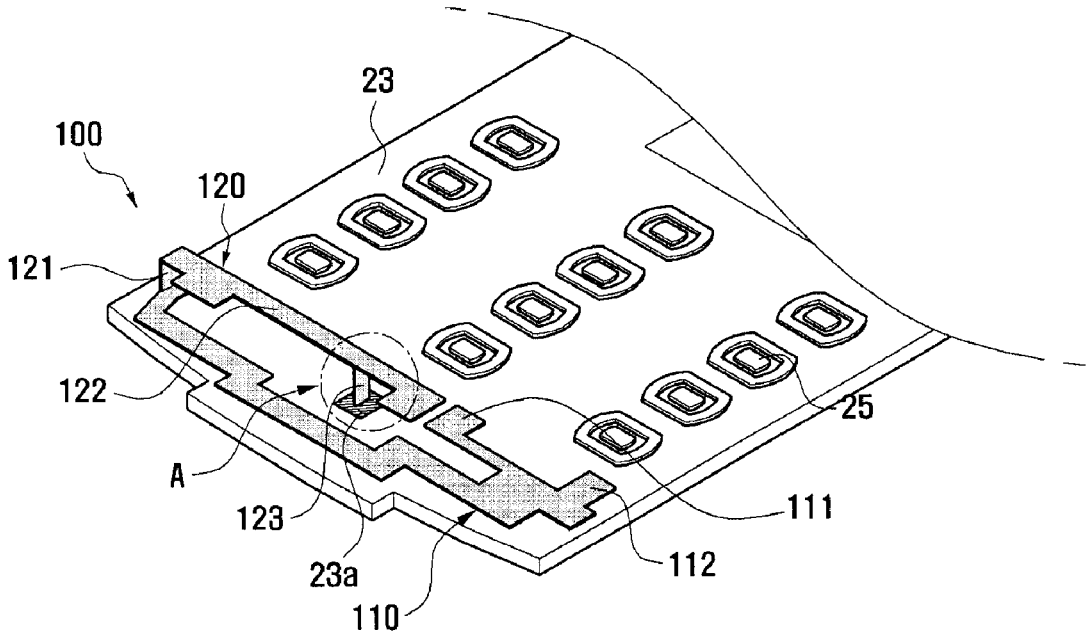
FIG. 3 is a partially perspective view illustrating a structure of an antenna apparatus of the mobile terminal of FIG. 1.
Figure 4:
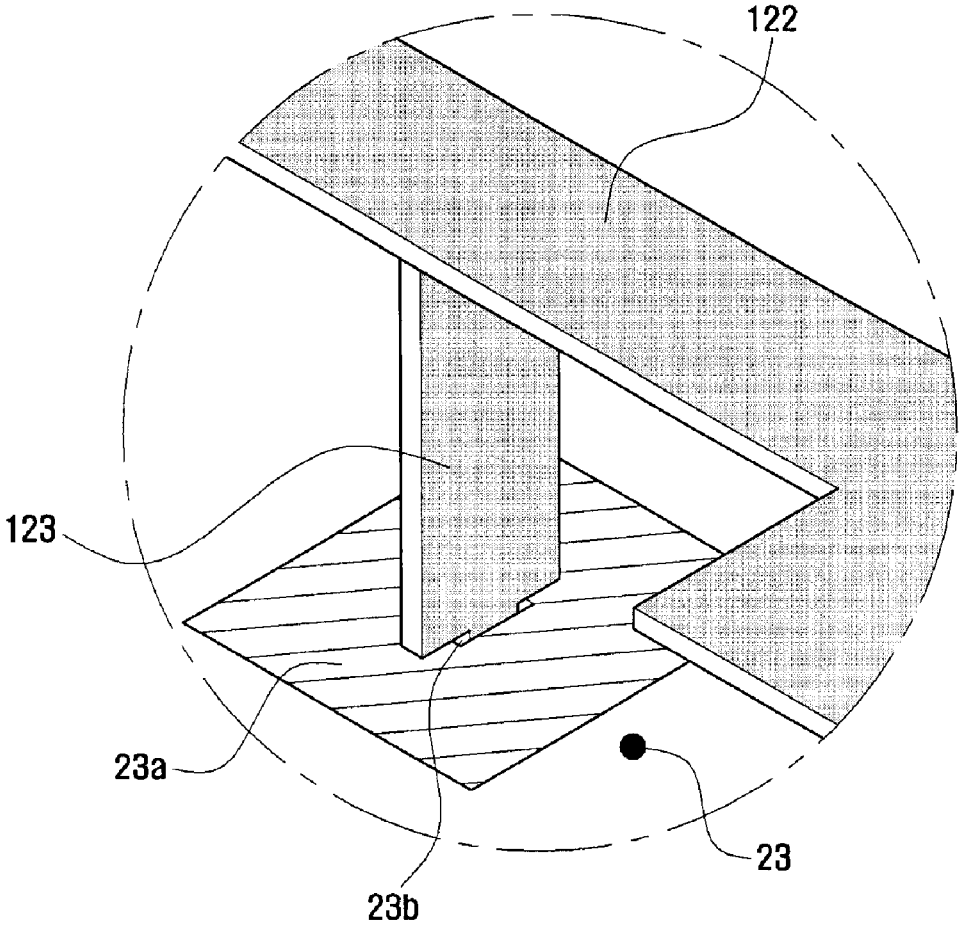
FIG. 4 is a partially enlarged perspective view illustrating a connection portion A of a first antenna portion and a second antenna portion in the antenna apparatus of FIG. 3.

FIG. 3 is a partially perspective view illustrating a structure of an antenna apparatus of the mobile terminal of FIG. 1, and FIG. 4 is a partially enlarged perspective view illustrating a connection portion A of a first antenna portion and a second antenna portion in the antenna apparatus of FIG. 3.

Referring to FIG. 3, the antenna apparatus 100 includes a first antenna portion 110 and a second antenna portion 120 and is installed in a lower end portion of the lower case 20. Preferably, the antenna apparatus 100 is installed in a lower end portion of the key input unit 21, and is separated from a plurality of electrode patterns 25 corresponding to a plurality of key buttons of the key input unit 21 and formed on the electronic circuit board 23. FIG. 3 illustrates an example in which the antenna apparatus 100 is installed at an upper surface of the electronic circuit board 23. However, it may be installed at a lower surface of the electronic circuit board 23, without altering the scope of the invention claimed.

The first antenna portion 110 is patterned at one surface of the electronic circuit board 23. A pattern shape of the first antenna portion 110 is determined in consideration of a frequency band of a wireless signal to be transmitted and received and the size of the forming space on the electronic circuit board 23. One end of the second antenna portion 120 is electrically connected to one end of the first antenna portion 110 and is formed in a can type to be separated from one side of the electronic circuit board 23. Preferably, the second antenna portion 120 is separated from the surface of the electronic circuit board 23 to be formed opposite to the first antenna portion 110. The second antenna portion 120 is made of a metal material. Here, the first antenna portion 110 is formed by forming a portion that can be positioned to be separated from a metal portion, such as the electrode pattern 25 of the key input unit 21 as a pattern on the electronic circuit board 23 in the entire antenna apparatus, and the second antenna portion 120 is formed by separately forming a portion adjacent to or overlapped with the metal portion such as the electrode pattern 25 of the key input unit 21 at upper space of the first antenna portion 110 in the entire antenna apparatus. Due to such a structure, the first antenna portion 110 and the second antenna portion 120 can be operated as one antenna for transmitting and receiving a wireless signal of a predetermined frequency band. Preferably, the first antenna portion 110 and the second antenna portion 120 can transmit and receive a wireless signal of a frequency band of 800 to 900 MHz. Therefore, the antenna apparatus 100 can reduce internal space of the mobile terminal 1 while using the first antenna portion 110 and the second antenna portion 120 as one antenna.

In this case, one end of the second antenna portion 120 is connected to one end of the first antenna portion 110 using a SMD (Surface Mount Device) method, and a connection pad (not shown) for electrically connecting one end of the first antenna portion 110 and one end of the second antenna portion 120 is provided on the electronic circuit board 23 at which the one end of the first antenna portion 110 is positioned. Further, a feed point 111 and a ground 112 connected to the electronic circuit board 23 are formed at the other end of the first antenna portion 110.

As shown in FIG. 3, the second antenna portion 120 is a can type antenna having an entirely thin and long plate form and is positioned at an upper space of the first antenna portion 110. The second antenna portion 120 is formed with a first portion 121 approximately perpendicularly formed from one end of the first antenna portion 110, second portion 122 extended from an end portion of the first antenna portion 110 and approximately formed to be parallel to the first antenna portion 110, and third portion 123 approximately perpendicularly formed from a position adjacent to the other end of the second antenna portion 120 to support the second antenna portion 120. As shown in FIG. 3, the third portion 123 performs a function of supporting the second portion 122 of the second antenna portion 120 so that the horizontal second portion 122 of the second antenna portion 120 is positioned parallel to the first antenna portion 110 on upper space of the first antenna portion 110.

The other end of the second antenna portion 120 is connected to one surface of the electronic circuit board 23 using an SMD method through a floating pad 23*a* formed on the one surface of the electronic circuit board 23. That is, as shown in FIG. 3, the third portion 123 of the second antenna portion 120 is connected to the floating pad 23*a* using an SMD method. A structure of the second antenna portion 120 shown in FIG. 3 is an example and a structure of the second antenna portion 120 is not limited thereto, and a form and length of the second antenna portion 120 are determined in consideration of a frequency band of a wireless signal to be transmitted and received and an internal space of a lower end portion of the lower case 20.

FIG. 4 is a partially enlarged perspective view illustrating a connection portion A of a first antenna portion and a second antenna portion in the antenna apparatus of FIG. 3.

Referring to FIG. 4, in order to fix and support the second antenna portion 120 to be separated from one surface of the electronic circuit board 23, a coupling hole 23*b* for inserting the other end of the second antenna portion 120 is formed in one surface of the electronic circuit board 23. A projection is formed at an end portion of the third portion 123 of the second antenna portion 120 to be inserted into the coupling hole 23*b*.

The antenna apparatus 100 shown in FIGS. 3 and 4 is an example and can be changed in consideration of a form or a size of a mobile terminal, an installation position of an antenna apparatus, and a frequency band of a wireless device to transmit and receive.

Effects when using the antenna apparatus 100 according to an exemplary embodiment of the present invention are described hereinafter with reference to experimental data of FIGS. 5B, 6B, and 7.

Figures 5A, 5B:
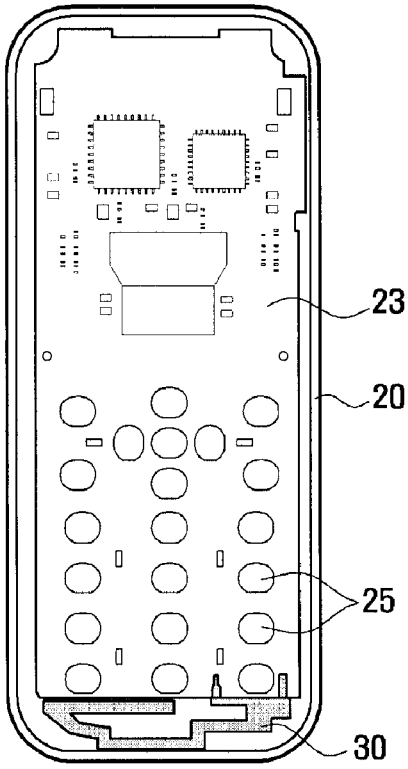
FIGS. 5A and 6A illustrate an antenna apparatus in which only a pattern is formed on an electronic circuit board.
FIGS. 5B and 6B are tables illustrating the result of radiation efficiency measured using a conventional antenna apparatus.
Figures 6A, 6B:
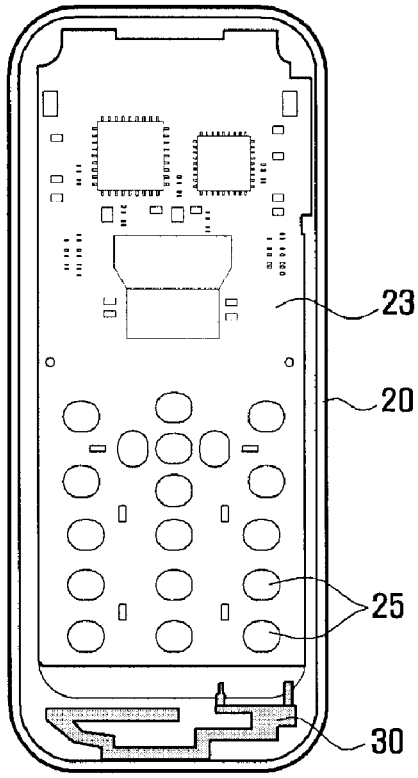

FIGS. 5B and 6B are tables illustrating the result of radiation efficiency measured using a conventional antenna apparatus, and FIG. 7 is a table illustrating the result of radiation efficiency measured using an antenna apparatus of a mobile terminal according to an exemplary embodiment of the present invention.

FIG. 5A illustrates an example in which an antenna apparatus 100 is formed in a pattern on the electronic circuit board 23 and is positioned to be adjacent to the electrode pattern 25 of the key input unit 21. FIG. 6A illustrates an example in which the antenna apparatus 100 is formed in a pattern on the electronic circuit board 23 and is positioned to be separated from the electrode pattern 25 of the key input unit 21. FIGS. 5B and 6B illustrate radiation performance when using the antenna apparatuses 100 of FIGS. 5A and 5B, respectively, and illustrate an antenna gain and antenna radiation efficiency measured on a frequency band basis.

Referring to FIG. 5B, when the antenna apparatus 100 is formed in a pattern on the electronic circuit board 23 and is positioned adjacent to the electrode pattern 25 of the key input unit 21, in a frequency band of 824 MHz to 894 MHz, an average antenna gain is −5.97 dBi and average antenna radiation efficiency is 26%. However as shown in FIG. 6B, when the antenna apparatus 100 is formed in a pattern on the electronic circuit board 23 and is positioned to be separated from the electrode pattern 25 of the key input unit 21, an average antenna gain is −4.19 dBi and average antenna radiation efficiency is 38% greater than a case where the antenna apparatus 100 is positioned adjacent to the electrode pattern 25 of the key input unit 21.

As can be seen in FIGS. 5A to 6B, when the antenna apparatus 100 is positioned adjacent to a metal portion, such as the electrode pattern 25 of the key input unit 21, an antenna gain and antenna radiation efficiency are lowered. However, when the antenna apparatus 100 is separated from a metal portion, performance is improved, but the size of the mobile terminal increases.

FIG. 7 illustrates a radiation performance when using the antenna apparatus 100 according to an exemplary embodiment of the present invention, in a frequency band of 824 MHz to 894 MHz. In this case, an average antenna gain is −2.49 dBi and average antenna radiation efficiency is 57% greater than those of the antenna apparatus 100 shown in FIG. 6A.

As described above, in the antenna apparatus 100 according to an exemplary embodiment of the present invention, the antenna apparatus 100 includes a first antenna 110 formed on the electronic circuit board 23 and a second antenna portion 120 spaced apart from an upper space of the first antenna portion 110 and connected to the first antenna portion 110. Thus, the separation from a metal portion, such as the electrode pattern 25 of the key input unit 21, prevents antenna radiation efficiency from being deteriorated by the metal portion. Therefore, while decreasing a size of the mobile terminal, an antenna gain and antenna radiation efficiency can be improved. Further, because the antenna apparatus 100 does not use a separate carrier, a structure of the antenna apparatus 100 can be simplified, and the internal space of the mobile terminal can be better used, and a production cost can be reduced.

As described above, the antenna apparatus is formed with a first antenna portion formed on an electronic circuit board and a second antenna portion positioned separated from an upper space of the first antenna and connected to the first antenna portion at one end and thus the antenna apparatus can be separated from a metal portion such as an electrode pattern of a key input unit and thus radiation efficiency of the antenna is prevented from being deteriorated by the metal portion. Further, because a separate carrier is not used for the antenna apparatus, a structure of the antenna apparatus is simplified, internal space of the mobile terminal can be better used, and a production cost can be reduced.

Further, an antenna gain and antenna radiation efficiency can be improved while decreasing a size of the mobile terminal.

Although exemplary embodiments of the present invention have been described in detail herein, it should be clearly understood that many variations and modifications of the basic inventive concepts herein described, which may appear to those skilled in the art, will still fall within the spirit and scope of the exemplary embodiments of the present invention as defined in the appended claims.

What is claimed is:

1. An antenna apparatus for transmitting and receiving a wireless signal installed on an electronic circuit board mounted within a main body of a mobile terminal, the antenna apparatus comprising:

a first antenna portion patterned on one surface of the electronic circuit board; and a can type second antenna portion electrically connected to one end of the first antenna portion and separated from the one surface of the electronic circuit board, wherein the one end of the second antenna portion is connected to the one end of the first antenna portion using a surface mounting device (SMD) method and the other end of the second antenna portion is connected to the one surface of the electronic circuit board using a SMD method through a floating pad formed in the one surface of the electronic circuit board, and a coupling hole in the floating pad for inserting the other end of the second antenna portion in the one surface of the electronic circuit board in order to fix and support the second antenna portion.

2. The antenna apparatus of claim 1, wherein the first antenna portion and the second antenna portion operate as one antenna, the first and second antenna portions being sized to transmit and receive a wireless signal in a predetermined frequency band.

3. A mobile terminal comprising:

a main body having an electronic circuit board therein; and an antenna apparatus for transmitting and receiving a wireless signal, the antenna apparatus electrically connected to the electronic circuit board, the antenna apparatus comprising:

a first antenna portion patterned on one surface of the electronic circuit board; and a can type second antenna portion electrically connected to one end of the first antenna portion and separated from the one surface of the electronic circuit board, wherein the one end of the second antenna portion is connected to the one end of the first antenna portion using a SMD method and the other end of the second antenna portion is connected to the one surface of the electronic circuit board using a SMD method through a floating pad formed in the one surface of the electronic circuit board, and a coupling hole in the floating pad for inserting the other end of the second antenna portion in the one surface of the electronic circuit board in order to fix and support the second antenna portion.

4. The mobile terminal of claim 3, wherein the antenna apparatus is installed at a lower end portion of a key input unit provided in a front surface of the main body and is separated from a plurality of electrode patterns corresponding to a plurality of key buttons of the key input unit and formed on the electronic circuit board.

5. The mobile terminal of claim 3, wherein the first antenna portion and the second antenna portion operate as one antenna and are sized to transmit and receive a wireless signal in a predetermined frequency band.

6. An antenna apparatus comprising:

a first antenna portion patterned on a first surface of a printed circuit board; and a second antenna portion separated and extending from the first antenna portion, wherein a first end of the first antenna portion and a first end of the second antenna portion are electrically connected by using a surface mounting device (SMD) method and a second end of the second portion is connected to a pad on the printed circuit board using a surface mounting device (SMD) method.

7. The antenna apparatus of claim 6, wherein the first antenna portion and the second antenna portion operate as a single element.

8. The antenna apparatus of claim 7, wherein the first antenna portion and the second antenna portion are sized to receive signals within a predetermined frequency band.

9. The antenna apparatus of claim 6, wherein the first antenna portion and the second antenna portion are offset from each other.

10. The antenna apparatus of claim 9, wherein the offset is in a vertical direction.

11. The antenna apparatus of claim 6, wherein the second antenna portion includes a can type antenna electrically connected to one end of the first antenna portion.

12. The antenna apparatus of claim 6, further comprising a coupling hole in the pad for inserting the other end of the second antenna portion in the one surface of the printed circuit board in order to fix and support the second antenna portion.

13. An antenna apparatus comprising:

a first antenna portion patterned on a first surface of a printed circuit board (PCB); and a second antenna portion separated from and extending parallel to the first antenna portion, wherein a first end of the first antenna portion and a first end of the second antenna portion are electrically connected by a connection extending perpendicular from the printed circuit board and the second end of the second antenna portion is connected to a pad on the printed circuit board;

wherein, when the first surface of the PCB is oriented horizontally, the first antenna portion and the second antenna portion are offset from each other in a horizontal direction.

* * * * *